United States Patent [19]

Morrison et al.

[11] 3,972,098

[45] Aug. 3, 1976

[54] METHOD OF PRODUCING AN UPHOLSTERED ITEM OF FURNITURE

[75] Inventors: Andrew I. Morrison, Brooklyn; Bruce R. Hannah, Staten Island, both of N.Y.

[73] Assignee: Knoll International, Inc., New York, N.Y.

[22] Filed: Sept. 26, 1973

[21] Appl. No.: 400,712

Related U.S. Application Data

[62] Division of Ser. No. 287,234, Sept. 8, 1972, Pat. No. 3,807,800.

[52] U.S. Cl. ..... 29/91.1; 29/91.2

[51] Int. Cl.[2] ..... B68G 7/05; B68G 7/12

[58] Field of Search ..... 29/91, 91.1, 91.2, 91.5, 29/91.7; 5/356

[56] References Cited

UNITED STATES PATENTS

| | | | |
|---|---|---|---|
| 543,218 | 7/1895 | Orr | 29/91.1 |
| 2,678,514 | 5/1954 | Soble et al. | 29/91.7 X |
| 3,678,553 | 3/1969 | Hermelin | 297/456 X |
| R11,778 | 10/1899 | Freschl | 29/91.7 |

*Primary Examiner*—Leon Gilden

*Attorney, Agent, or Firm*—Cooper, Dunham, Clark, Griffin & Moran

[57] ABSTRACT

An method item of furniture in which tufting buttons have both a decorative tufting effect and serve to attach a padding to a frame. The tufting buttons have internally threaded shank portions, and screws are threaded into such shank portions to secure the padding to a frame. A cushion assembly is provided by forming ridges on the shank portions of the tufting buttons and utilizing washer-type fasteners that are attached to the shank portions to hold the tufting buttons in place.

A methods of producing an upholstered item of furniture that utilizes a flexible plate which is substantially flat in the non-flexed state and which is flexed to and held in a desired curvature in the completed item of furniture. The plate is upholstered in the substantially flat, non-flexed state. Thereafter the upholstered plate is flexed to a desired curvature and secured in its flexed state.

2 Claims, 7 Drawing Figures

Fig. 5.
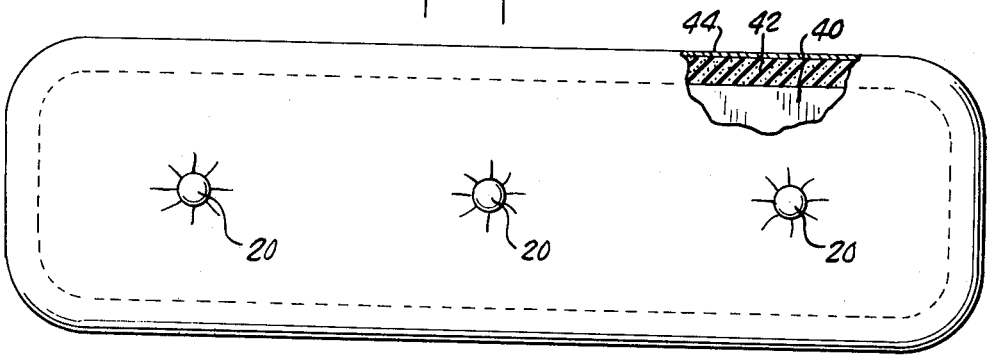
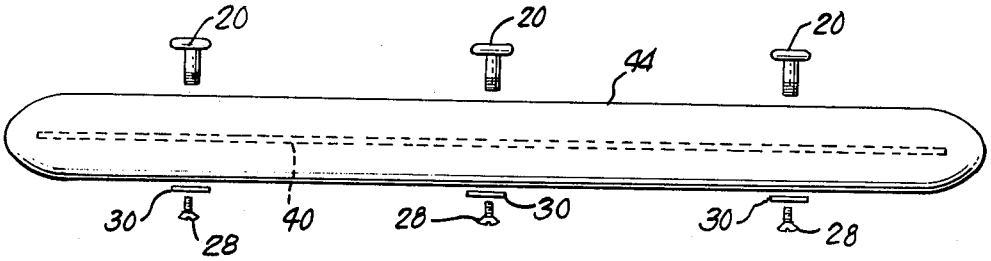
Fig. 6.
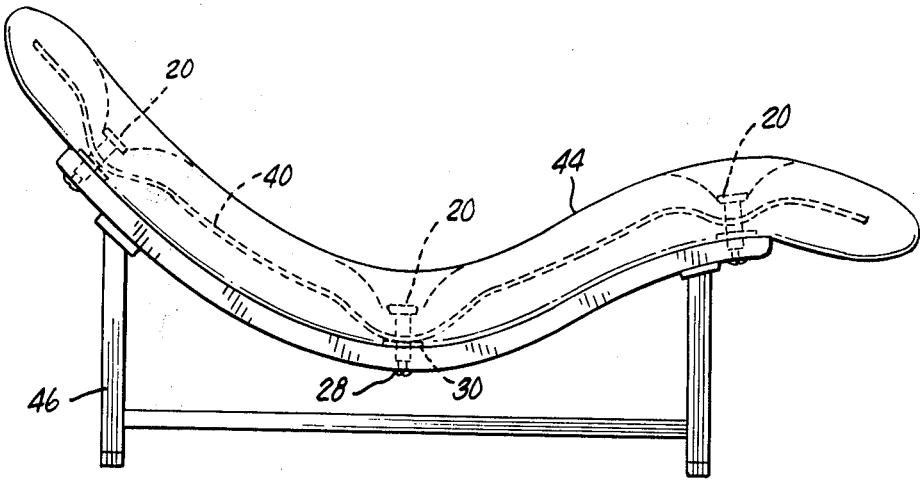
Fig. 7.

METHOD OF PRODUCING AN UPHOLSTERED ITEM OF FURNITURE

This is a division of application Ser. No. 287,234 filed Sept. 8, 1972.

BACKGROUND AND BRIEF DESCRIPTION OF THE INVENTION

This invention relates to upholstered items of furniture. The invention involves the use of a tufting button which has both a decorative effect and which serves to hold padding to a frame.

The invention also involves a method of producing an upholstered item of furniture in which the upholstering is easily accomplished through the use of a flat plate which is flexed to a desired curvature following the upholstering.

In the fabrication of furniture, it is desirable to have the assembly of such furniture as simple as possible. To this end, the present invention utilizes a tufting button which provides not only the usual decorative tufting effect but which also serves to hold padding onto a frame. Desirably, such tufting buttons serve as the sole means of attachment of the padding to the frame. Furthermore, an upholstery method is employed which utilizes a flexible plate which is substantially flat in the non-flexed state and which is flexed to and held in a desired curvature in the completed item of furniture. The substantially flat, non-flexed plate is upholstered, which is easily accomplished because of the flatness of the plate. Following upholstering, the plate is then flexed to the desired curvature and secured in the flexed state. The tufting buttons just referred to may serve to secure the upholstered plate in the flexed state to a frame, creating a tufting in the upholstery.

Representative prior art patents are as follows:

| U.S. Pat. No. | Inventor | Issue Date |
|---|---|---|
| 2,541,835 | E. Saarinen | Feb. 13, 1951 |
| 2,940,511 | E. S. Gomes | June 14, 1960 |
| 2,993,733 | J. P. Pinkham | July 25, 1961 |
| 3,009,740 | G. Nelson, et a.. | Nov. 21, 1961 |
| 3,014,762 | A. Mauser | Dec. 26, 1961 |
| 3,069,204 | I. K. Vesterholt, et al. | Dec. 18, 1962 |
| 3,121,588 | R. Beckman, et al. | Feb. 18, 1964 |
| 3,127,201 | H. Granlund | March 31, 1964 |
| 3,206,251 | J. G. Stevens | Sept. 14, 1965 |
| 3,233,253 | A. Cauvin | Feb. 8, 1966 |
| 3,266,065 | S. Bereday | Aug. 16, 1966 |
| 3,285,660 | R. Beckman, et al. | Nov. 15, 1966 |
| 3,295,890 | P. N. G. Murdoch | Jan. 3, 1967 |
| 3,523,710 | C. J. Barecki, et al. | Aug. 11, 1970 |
| Re. 27,336 | S. Bereday | Apr. 11, 1972 |
| Belgium Patent No. 545,957 (1956) | | |

The invention will be more completely understood by reference to the following detailed description, to be read in conjunction with the appended drawing.

BRIEF DESCRIPTION OF THE DRAWING

FIGS. 5 to 7 illustrate an upholstery method in accordance with the invention.

DETAILED DESCRIPTION

Figure 1:
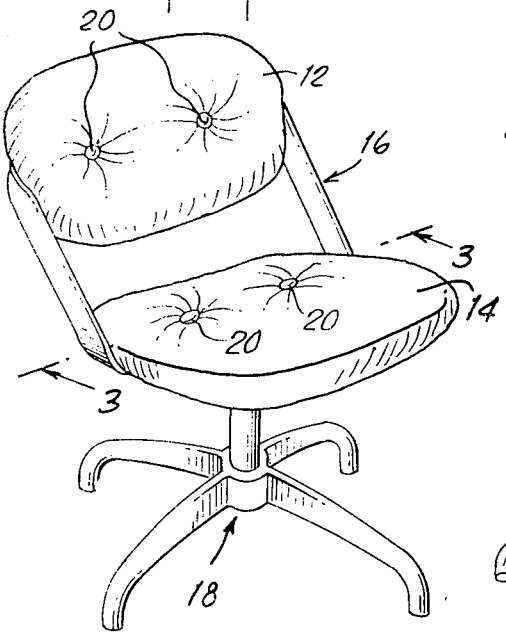
FIGS. 1 and 2 are perspective views of a chair embodying the invention.
Figure 2:
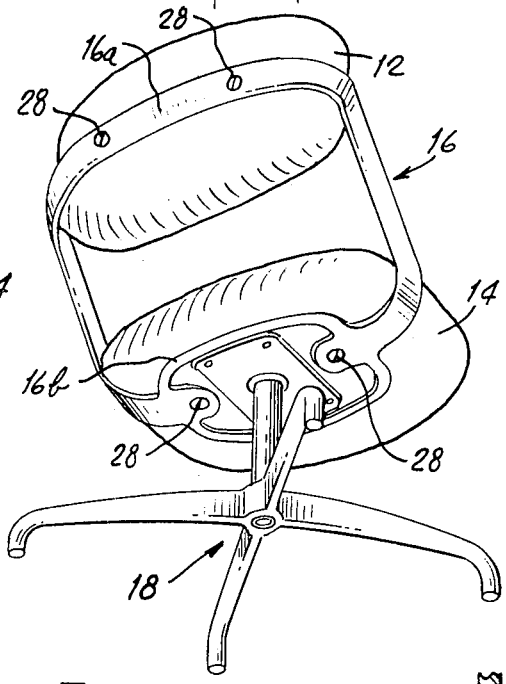

Referring to FIGS. 1 and 2, a chair is shown embodying the invention. The chair includes a back rest portion 12 and seat portion 14. The back rest and seat portions are secured to a frame 16 as will be described in more detail below. The frame 16 includes a back rest support section **16*a* and a seat support section 16*b*. Attached to the seat support section 16*b* is a conventional pedestal assembly 18**.

Figure 3:
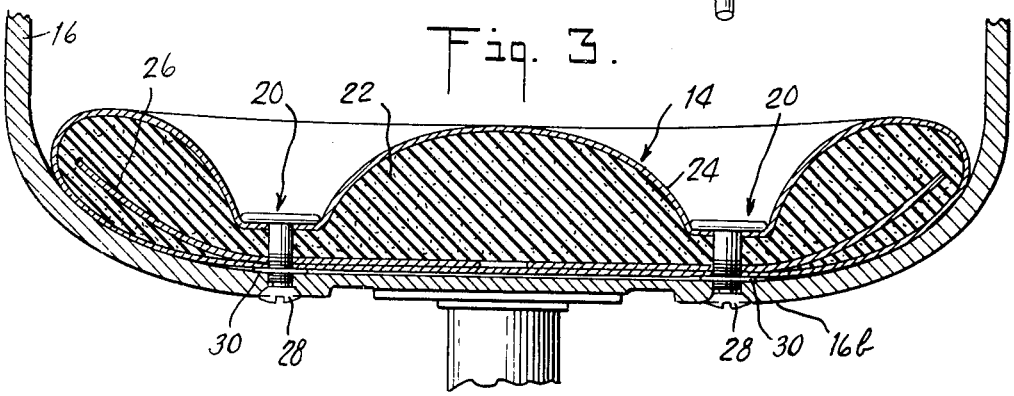
FIG. 3 is a sectional view to an enlarged scale, of the chair shown in FIG. 1, taken along the section 3—3 in FIG. 1.
Figure 4:
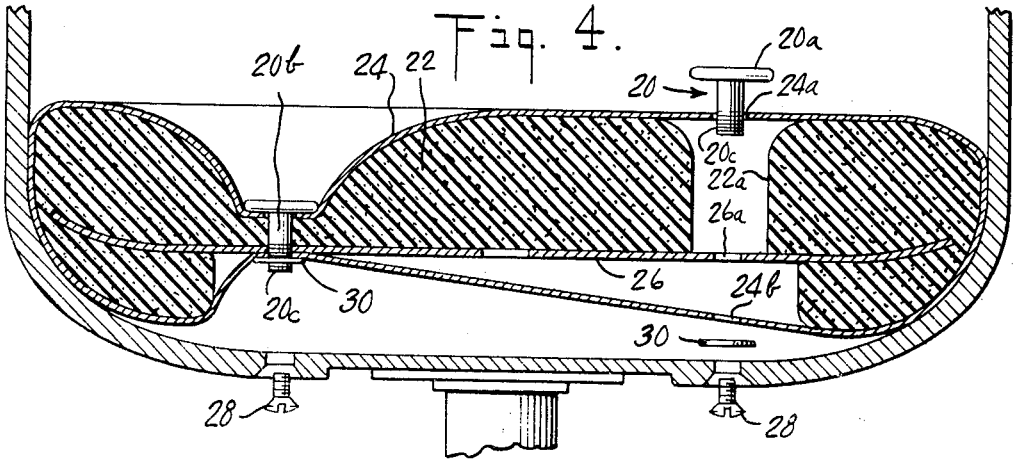
FIG. 4 is a sectional view similar to that of FIG. 3 showing the details of the forming of a cushion assembly.

The back rest 12 and seat 14 are secured to the frame 16 by means of tufting buttons 20 which provide both a decorative tufting effect and a fastening effect. Referring to FIGS. 3 and 4, which show the fastening of the seat 14 to the seat support section **16*b* of the frame, it will be noted that the seat 14 comprises a padding 22 which is covered by an upholstery material 24. Positioned within the padding is a stiffening element 26. The padding 22 includes holes 22*a* therethrough; likewise the upholstery material 24 includes holes 24*a* and 24*b* therethrough as does the stiffening element 26 (holes 26*a* therethrough). A tufting button 20 that is used includes a head portion 20*a* that is exposed to view and which provides the decorative effect. The tufting button also includes a shank portion 20*b* which is internally threaded so that a screw 28 may be threaded therein to hold the seat 14 in place. The shank portion 20*b* of the tufting button is also grooved on the outside thereof, as at 20*c*, in order to receive a washer 30**.

Referring to FIG. 4, the seat 14 may be considered to be a cushion assembly which includes the padding 22, the stiffening element 26 and the upholstery material 24. The tufting buttons are positioned so that the shank portions **20*b* pass through the holes 22*a*, 24*a* and 24*b*, and 26*a* respectively in the padding, upholstery material and stiffening element. The washers 30 are pressed onto the ridged ends 20*c*** of the shank portions of the tufting buttons. This provides a cushion assembly which may be independently stored or used immediately.

The cushion assembly is fastened to the frame 16 as shown in FIGS. 3 and 4. In particular, the screws 28 pass through the frame section **16*b* and are threaded into the internally threaded shank portions of the tufting buttons 20. Tightening of the screws 28 produces the finished chair assembly shown in FIG. 3**.

The back rest 12 of the chair is held to the frame section **16*a* by the same technique utilizing tufting buttons 20 and screws 28**.

Referring to FIGS. 5 to 7, an upholstery technique is shown utilizing a flexible plate 40 which is substantially flat in the non-flexed state thereof as shown in FIG. 6. The flexible plate 40 is similar to the stiffening element 26 shown in FIGS. 3 and 4 described above. The plate 40 may be flexed to a desired configuration or curvature in the completed item of furniture, as shown in FIG. 7. However, in the non-flexed state thereof, it is substantially flat as just described. In the non-flexed state thereof, the plate 40 is upholstered. The upholstery may take the form of a resilient foam material 42 and a covering fabric 44. The upholstering of the substantially flat, non-flexed plate 40 is relatively simple, inasmuch as no difficult curves are present. Any sewing that need be done is essentially "two-dimensional."

Following the upholstering of the plate 40, the plate may be flexed and secured to a frame 46. To this end, tufting buttons 20, screws 28 and washers 30 as described above in connection with the chair of FIGS. 1 to 4 may be utilized in securing the upholstered plate to the frame 46.

Any desired curvature may be utilized. FIG. 7 shows a chaise lounge as an example. A chair or other items of furniture could be produced. Additionally, portions of the flexible plate might be bent adjacent other portions thereof and secured to each other by fasteners, such as the tufting buttons 20. A multiplicity of various shapes can be produced. One unit may be attached to another unit, for example, to gang together chairs. Further, the item may be adjustable, for example, a seat back angle adjustment is possible with one upholstered flexible plate, or a lounge chair might be convertible to a bed. What is important is that a substantially flat plate is utilized in the non-flexed state to facilitate the upholstering thereof, which is thereafter shaped to a desired curvature and secured in place. If upholstery repair or reupholstering or cleaning must be completed, the upholstered flexible plate is simply removed from the supporting framework; it returns to the substantially flat, non-flexed state in which the repairs or reupholstering or cleaning may be completed.

The upholstering of a flat plate has a great advantage over prior art arrangements in which a flexible plate has been utilized for an item of furniture, bent to its desired configuration and then upholstered. There is no simplification of upholstering in such a prior art arrangement.

The invention has been described above in terms of representative, presently preferred embodiments. It is clear that these embodiments are subject to modification. For example, the tufting buttons 20 need not be in the shape of traditional "buttons" but rather may be in the form of U-shaped bars or T-shaped elements, for example. Other configurations will suggest themselves to those skilled in the art. Accordingly, the invention should be taken to be defined by the following claims.

What is claimed is:

1. A method of producing an upholstered item of furniture comprising completely upholstering a stiffly flexible substantially flat plate while said plate is in its substantially flat and non-flexed state, flexing the completely upholstered plate to a desired and final curvature, and securing the completely upholstered plate in its flexed state of desired and final curvature to complete the item of furniture without further upholstering so that all upholstering is completed while said plate is substantially flat.

2. A method according to claim 1, in which the upholstered plate is secured in the flexed state to a frame through the use of buttons which serve to create tufting in the upholstery.

* * * * *